US007081187B1

(12) United States Patent
Schutt

(10) Patent No.: US 7,081,187 B1
(45) Date of Patent: Jul. 25, 2006

(54) INTERNAL CATHODIC PROTECTION SYSTEM

(75) Inventor: William R. Schutt, Doylestown, PA (US)

(73) Assignee: Matcor, Inc., Doylestown, PA (US)

( * ) Notice: Subject to any disclaimer, the term of this patent is extended or adjusted under 35 U.S.C. 154(b) by 318 days.

(21) Appl. No.: 10/617,994

(22) Filed: Jul. 11, 2003

Related U.S. Application Data

(60) Provisional application No. 60/398,275, filed on Jul. 24, 2002.

(51) Int. Cl.
*C23F 13/06* (2006.01)
*C23F 13/08* (2006.01)
*C23F 13/10* (2006.01)

(52) U.S. Cl. ..... 204/196.2; 204/196.33; 204/196.34; 204/196.35; 204/196.36; 204/196.21; 204/196.26; 204/196.11; 204/196.16

(58) Field of Classification Search ..... 204/196.11, 204/196.16, 196.2, 196.26, 196.33, 196.34, 204/196.35, 196.21, 196.36
See application file for complete search history.

(56) References Cited

U.S. PATENT DOCUMENTS

| | | | | |
|---|---|---|---|---|
| 4,140,614 | A | 2/1979 | McKie | |
| 4,400,259 | A | 8/1983 | Schutt | |
| 4,442,903 | A * | 4/1984 | Schutt et al. | 166/385 |
| 4,871,328 | A * | 10/1989 | Wright et al. | 439/589 |
| 5,055,166 | A | 10/1991 | Schutt | |
| 5,176,807 | A * | 1/1993 | Kumar | 204/196.06 |
| 6,238,545 | B1 | 5/2001 | Allebach et al. | |

* cited by examiner

*Primary Examiner*—Bruce F. Bell
(74) *Attorney, Agent, or Firm*—Caesar, Rivise, Bernstein, Cohen & Pokotilow, Ltd.

(57) ABSTRACT

A cathodic protection system for internal surfaces of a pipeline is provided which includes a flexible anode assembly having a first and a second end and having at least one flexible anode wire having a first end and a second end. First and second removable pressure seal fittings are provided for the ends of the anode assembly that provide for electrical contact between the ends of the anode assembly and contacts outside of the internal volume of the pipeline. The system includes a DC power source where anode conductors are attached between the contacts and the DC power source. A second embodiment is provided that includes only a single pressure seal fitting.

30 Claims, 4 Drawing Sheets

INTERNAL CATHODIC PROTECTION SYSTEM

CROSS-REFERENCE TO RELATED APPLICATIONS

This application claims the benefit of U.S. Provisional Application Ser. No. 60/398,275, entitled Internal Cathodic Protection Systemt, filed Jul. 24, 2002.

BACKGROUND OF THE INVENTION

This invention relates to cathodic protection systems and, more particularly, to cathodic protection systems for the internal surfaces of pipes.

Protection against the corrosion of metals, for example, iron and steel, has been provided successfully and at relatively low cost by cathodic protection either by the use of sacrificial anodes or by using permanent anodes coupled to one or more potential sources. These systems overcome and reverse the natural potential difference which is set up whenever a metal is immersed in an electrolyte such as saltwater. Apparatus and systems have evolved which satisfactorily protect ships, liquid-containing tanks, bridges and other structures, and the internal and external surfaces of ducts and pipelines.

Wherever an electrolyte such as saltwater is passed through pipelines, the problem of internal protection is acute. To give reasonable installed life of the pipelines under these circumstances it has been necessary to make the pipes substantially thicker than strength considerations would otherwise call for in order to avoid frequent and costly replacement. Since the pipes and the labor costs of replacing the pipes are costly, the need for providing effective and inexpensive internal protection is fully apparent.

Cathodic protection is accomplished by causing a flow of direct current (DC) between an electrode (called the anode) and the structure (called the cathode), e.g., the pipe. The direct current causes the surface of the structure (pipe) to become polarized, thus stopping or reducing corrosion.

In an impressed current cathodic protection system, a rectifier normally converts AC to DC and supplies the current. Typically, the anode is a relatively inert material that can transfer the current to the liquid in the pipe, which is the electrolyte. In a galvanic system, the anode is an electrochemically active metal compared to the cathode, and the current is a natural occurrence of connecting the anode and cathode together.

The chemical reaction at the anode is metal oxidation, with oxygen, or chlorine evolution. Both ions and electrons are formed at the anode. Ions generated by the reaction flow to the cathode via the electrolyte. The electrons flow to the cathode via a connection. Reduction occurs at the cathode, which consumes the electrons. Three common cathodic reactions in cathodic protection are as follows:

$$O_2+2H_2O+4e\rightarrow 4OH^-$$

$$O_2+4H^++4e\rightarrow 2H_2O$$

$$2H^++2e\rightarrow H_2$$

In all cases, both electron and ionic currents are involved in cathodic protection. That is, both a continuous common electrolyte and a metallic connection between the anode and cathode are required. The metallic connection is provided through the rectifier. The saltwater or other conductive liquid provides the common electrolyte.

Common anode materials include pure metals, alloyed metals, platinum coated valve metals, valve metals having electrochemically active coatings, and certain ceramic materials.

Generally, the internal surfaces of pipelines have been protected in the past by probe anodes or sacrificial linear anodes. Probe anodes are placed into the pipeline at intervals along the pipeline. The probe anode consists of a rigid anode mounted in a fitting that is inserted into the pipeline, generally through a pressure-tight fitting. The probe anode is generally placed perpendicular to the axis of the pipeline and is of no greater length than the diameter of the pipeline. Probe anodes have several disadvantages. First, each probe anode can provide protection for only about four to eight pipe diameters along the length of the pipeline. It would be beneficial to have a system that is continuous and provides uniform protection along the entire length of the pipeline. Second, the probe anode must be installed at regular intervals. This is relatively costly and may affect the integrity of the pipeline. Additionally, the use of a probe anode system may not be possible with underground pipelines. It would be beneficial to provide a system that can cover long distances, for example, distances of five hundred feet or more. Finally, probe anode systems do not provide uniform current distribution. It would be beneficial to provide more uniform current distribution. In the present invention, there is less risk of hydrogen embrittlement of the pipeline metal and less risk of damage to internal coatings.

Sacrificial anodes also have several disadvantages. A sacrificial anode system consists of sacrificial anodes placed inside of the pipeline. The anode material is generally magnesium, zinc, or aluminum alloy. The anode can be in ribbon form of approximately one inch diameter or in block form. The anodes typically contain a steel core and are bolted or welded to the metal pipeline.

The anodes operate via the difference in potential of the metals. For example, zinc has an open circuit potential to a copper—copper sulfate reference electrode of −1.10 VDC, whereas steel would have a potential of −0.55 VDC. The driving voltage would be slightly higher with magnesium and some aluminum alloys. The system is self regulating and, once the anode material is used, the entire system must be replaced.

Again, a sacrificial anode system has several disadvantages. First, it is of relatively high cost. Second, the life of the anodes is limited. Third, the sacrificial anode system is relatively heavy. For example, a sacrificial anode may be about one pound per linear foot or more. Fourth, a sacrificial anode may not have sufficient driving voltage to produce a required DC voltage. With an impressed current system, a transformer rectifier can be provided that will produce much higher driving voltages. Fifth, a sacrificial anode may put metals such as zinc into the liquid stream. Finally, replacement of anodes is difficult.

The present invention improves or corrects these deficiencies.

Several patents are now discussed as general background information. U.S. Pat. No. 6,238,545 (Allebach et al.) discloses an anode embedded in an electrolyte layer applied to the surface of a pipe section to provide an ionic conductive path between the anode and the structure to supply cathodic protection to the structure where the natural environment may not provide a continuous electrolyte. This design protects the exterior of pipes.

U.S. Pat. No. 4,140,614 (McKie) teaches an anode arrangement for use for the internal cathodic protection of a pipe. Here, a hollow anode carrier is connected along the length of the pipe. The anode is offset, but communicates with the channel defined by the pipe so that the anode lies within the recess, but does not obstruct flow in the pipe.

The references cited herein are incorporated herein by reference in their entireties.

SUMMARY OF THE INVENTION

A cathodic protection system is provided for internal surfaces of a pipeline. The pipeline has an internal volume. The cathodic protection system includes a flexible anode assembly having a first end and a second end and having at least one flexible anode wire having a first end and a second end. A first removable pressure seal fitting is provided for the first end of the anode assembly. The first pressure seal fitting provides for electrical contact between the first end of the anode assembly and a first contact outside of the internal volume of the pipeline. A second removable pressure seal fitting is provided for the second end of the anode assembly. The second pressure seal fitting provides for electrical contact between the second end of the anode assembly and a second contact outside of the internal volume of the pipeline. The cathodic protection system further includes a DC power source, a first anode conductor attached between the first contact and the DC power source, and a second anode conductor attached between the second contact and the DC power source.

The cathodic protection system may optionally include a flexible, non-electrically conductive anode housing where the housing substantially surrounds the anode wire and preferably extends generally from the first pressure seal fitting to the second pressure seal fitting. The anode housing may be fabricated from, for example, a perforated, semi-rigid plastic material, or, for example, from plastic mesh tubing.

The anode wire may be, for example, mixed metal oxide with or without a copper core, or may be platinum coated titanium with or without a copper core, or may be platinum coated niobium with or without a copper core.

The first and the second pressure seal fittings preferably permit installation, removal, and repair of the anode assembly. The DC power source preferably is a rectifier. A waterproof coating over at least one the pressure seal fittings may be provided such that the anode assembly is adapted for underground use. One or more reference electrodes may be provided to measure cathodic protection levels and to monitor the anode assembly. Finally, a separate anode cable may be provided to provide supplemental tensile strength to the anode wire.

In an alternate embodiment of the present invention, a cathodic protection system is provided for internal surfaces of a pipeline. The pipeline has an internal volume. The cathodic protection system includes a flexible anode assembly having a first and a second end and having at least one flexible anode wire having a first end and a second end. A first removable pressure seal fitting is provided for the first end of the anode assembly. The first pressure seal fitting provides for electrical contact between the first end of the anode assembly and a first contact outside of the internal volume of the pipeline. The cathodic protection system further includes a DC power source and a first anode conductor attached between the first contact and the DC power source. The length of the anode assembly has a greater dimension than that of a diameter of the pipeline and is free to move within the pipeline due to the flexibility of the anode assembly.

A flexible, non-electrically conductive anode housing may be provided where the housing substantially surrounds the anode wire and extends generally from the first pressure seal fitting to the second end of the anode assembly. The anode housing may be fabricated from, for example, a perforated, semi-rigid plastic material or from plastic mesh tubing.

The anode wire may be, for example, mixed metal oxide with or without a copper core, platinum coated titanium with or without a copper core, or platinum coated niobium with or without a copper core.

Preferably, the first pressure seal fitting permits installation, removal, and repair of the anode assembly. Preferably, the DC power source includes a rectifier. A waterproof coating may be provided over the first pressure seal fitting such that the anode assembly is adapted for underground use. At least one reference electrode may be provided to measure cathodic protection levels and to monitor the anode assembly. Finally, a separate anode cable may be used to provide supplemental tensile strength to the anode wire.

BRIEF DESCRIPTION OF SEVERAL VIEWS OF THE DRAWINGS

The invention will be described in conjunction with the following drawings in which like reference numerals designate like elements throughout the several views and wherein.

DETAILED DESCRIPTION OF THE INVENTION

The internal cathodic protection system for pipelines of the present invention is an impressed current cathodic protection system to protect the internal surfaces of pipes, in, for example, pipelines. Generally, the system's primary application is for water lines including potable, brackish, and saltwater pipelines. However, the system may be installed with for use with any appropriate corrosive liquid.

Generally, the system consists of one or more continuous, linear, flexible anodes that is installed in the pipe. Associated with each flexible anode is a pair of pressure seal fittings located at each end of the length of the anode such that an electrical connection provides for the anode to be connected to a DC power source. There is substantially no limit to the length of piping that can be protected by the system since numerous anodes and their corresponding pressure seal fittings may be used. Preferably, each anode should be no longer than a little more than five hundred feet.

Figure 1:
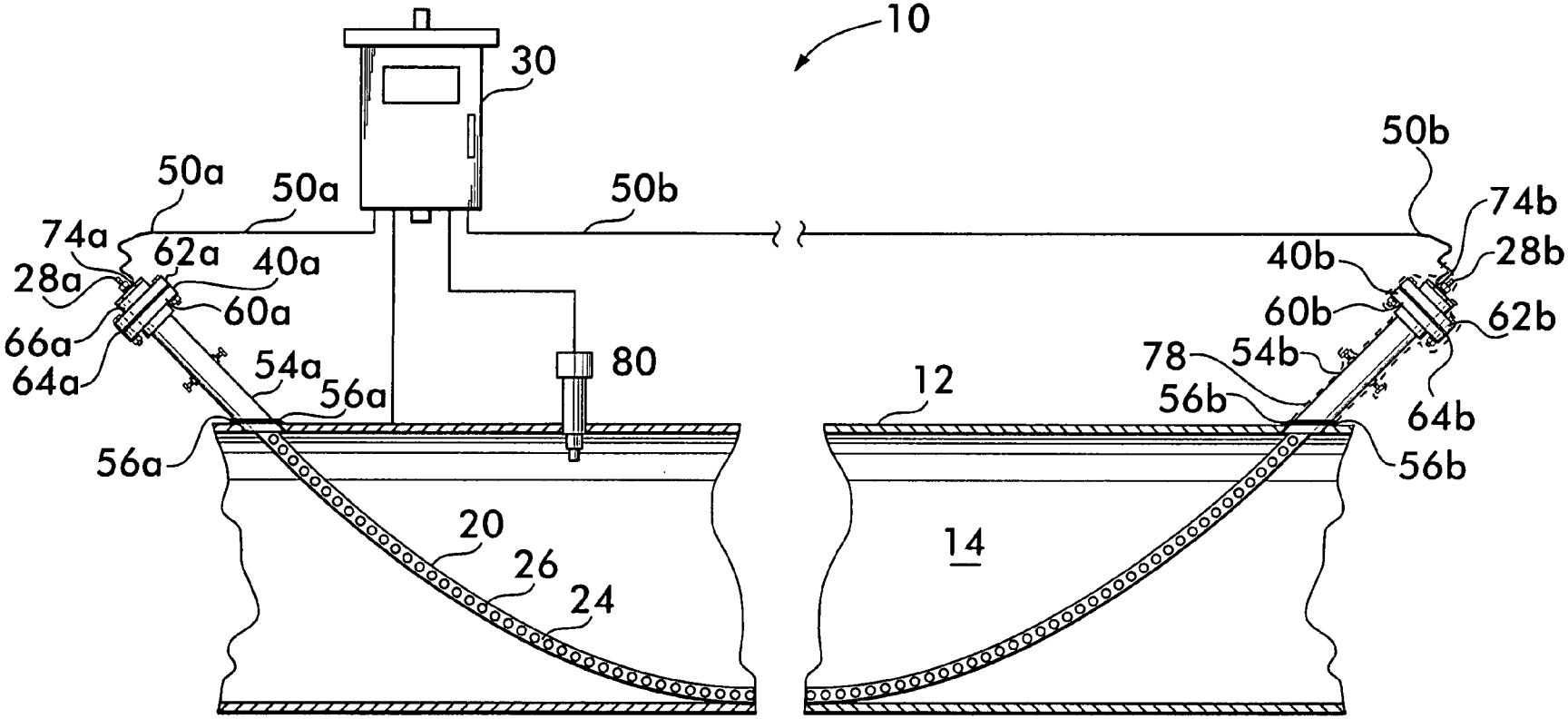
FIG. 1 is a simplified, partially cut-away, side elevational view of an internal cathodic protection system in accordance with one preferred embodiment of the present invention.
Figure 2:
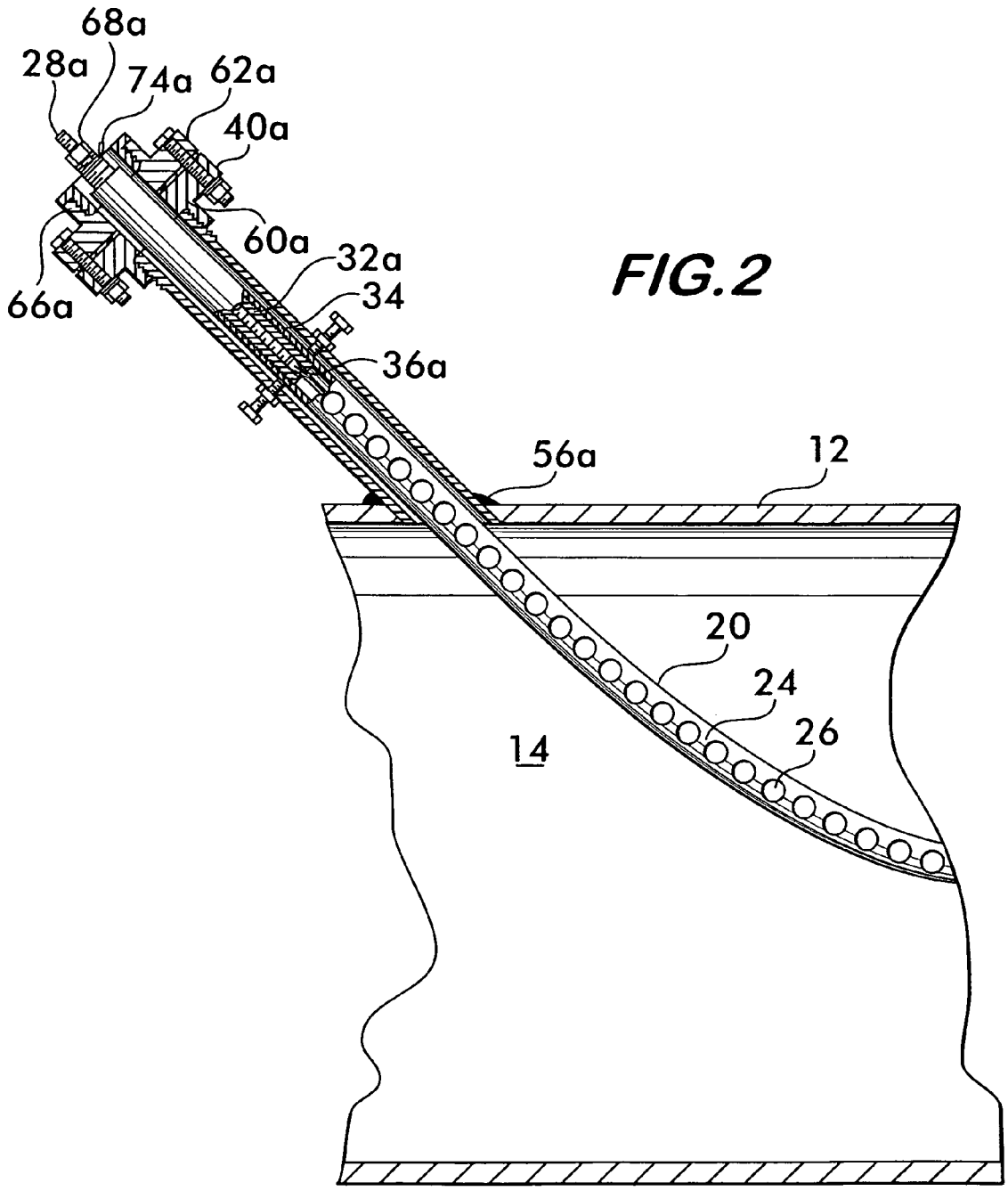
FIG. 2 is a simplified, partially cut-away elevational view of the internal cathodic protection system of FIG. 1, showing a cutaway anode assembly.

Referring now to the drawings, wherein like part numbers refer to like elements throughout the several views, there is shown in FIGS. 1 and 2 a cathodic protection system 10 for the internal surfaces of piping in accordance with one preferred embodiment of the present invention. The cathodic protection system 10 is for protecting the internal surfaces of piping 12. As indicated above, one or more cathodic protection systems 10 may be used together to protect substantially any length piping. If more than one system 10 is used, the anodes are placed end to end. The cathodic protection system 10 generally includes an anode assembly 20 having first and second ends, a DC power source, for example, in the form of a rectifier 30, a first and a second pressure seal fitting 40*a*, 40*b* and first and second conductors, for example, in the form of conductor wires 50*a*, 50*b* which connect the anode assembly 20 from the pressure seal fittings 40*a*, 40*b* to the rectifier 30.

Each of these elements will now be described in greater detail. For purposes of the present invention, only one end of the system 10 will be described in detail. However, for this preferred embodiment of the present invention, both ends are substantially identical. For purposes of the present invention where the two ends of the system are identical, like part numbers are used with the first end having an "a" suffix and the second end having a "b" suffix. For example, threaded rod 28*a* on the first side is equivalent to threaded rod 28*b* on the second side.

The anode wire 22 of the anode assembly 20 may be fabricated from a variety of materials, as well known in the art. For example, the anode wire 22 may be fabricated from a mixed metal oxide coating or a platinum coating over titanium or niobium. The anode wire 22 may or may not have a core of, for example, copper. The anode wire 22 has a first end 22*a* and a second end 22*b* and is preferably about 0.031 to about 0.125 inches in diameter. Outputs available for the anode may be desirable, for example, at about 16 milliamperes per linear foot to about 250 milliamperes per linear foot.

Figure 5:
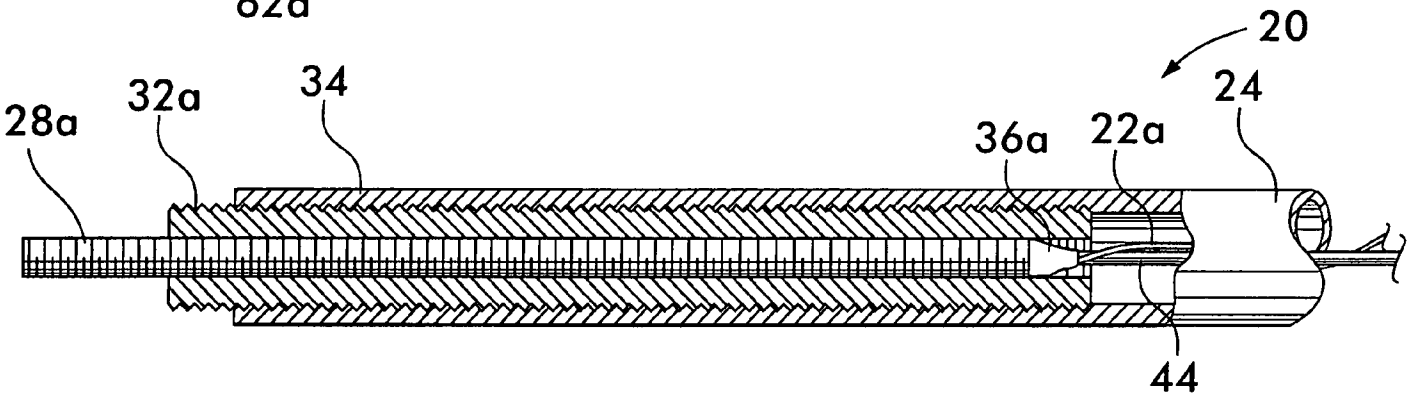
FIG. 5 is a partial, simplified, side elevational view of the anode assembly of FIG. 4.

As can best be seen in FIG. 5 where a preferred embodiment of one end of the anode assembly 20 is shown, the first end 22*a* and the second end 22*b* of the anode wire 22 are crimped and/or soldered (crimp 36*a* shown) to a stainless steel threaded rod 28*a*, 28*b* for example, about eight inches long and three-eighths of an inch in diameter. The threaded rod 28*a* is threaded through an end portion of an externally threaded reducer pipe 32*a*, to secure the anode wire 22/threaded rod 28*a* to the reducer pipe 32*a*. A portion of the threaded rod 28*a*, the crimp 36*a*, and a portion of the anode wire 22 are preferably all contained in the volume of the reducer pipe 32*a*. For additional tensile support of the anode wire 22, a cable 44 may be also be crimped and/or soldered at crimp 36*a*. Here, the cable 44 is somewhat shorter than the anode wire 22 such that when the anode wire 22 is pulled through the piping 12, or when a liquid is flowing through the piping 12, the cable 44 takes the load, rather than the anode wire 22. At the point of the crimp 36*a*, heat shrink tubing may optionally be used around this assembly to facilitate a strong connection.

As can be seen in FIG. 5, the anode assembly 20 also includes a housing 24. The housing 24 contains the anode wire 22 and is preferably non-metallic and non-electrically conductive. The housing 24 may be constructed from, for example, a semi-rigid plastic material with perforations 26 or plastic mesh tubing to allow liquid to flow therethrough. Preferably, the housing 24 is inert to chlorine gas. For purposes of the present invention, the term "flexible" is intended to encompass the term semi-rigid. The reducer pipe 32*a* is secured to the housing 24 with, for example, epoxy 34. Optionally, both the housing 24 and reducer pipe 32*a* are filled with epoxy 34. To facilitate a strong bond, holes may be drilled in either/both the housing 24 and reducer pipe 32*a* for the epoxy 34 to flow through.

Figure 3:
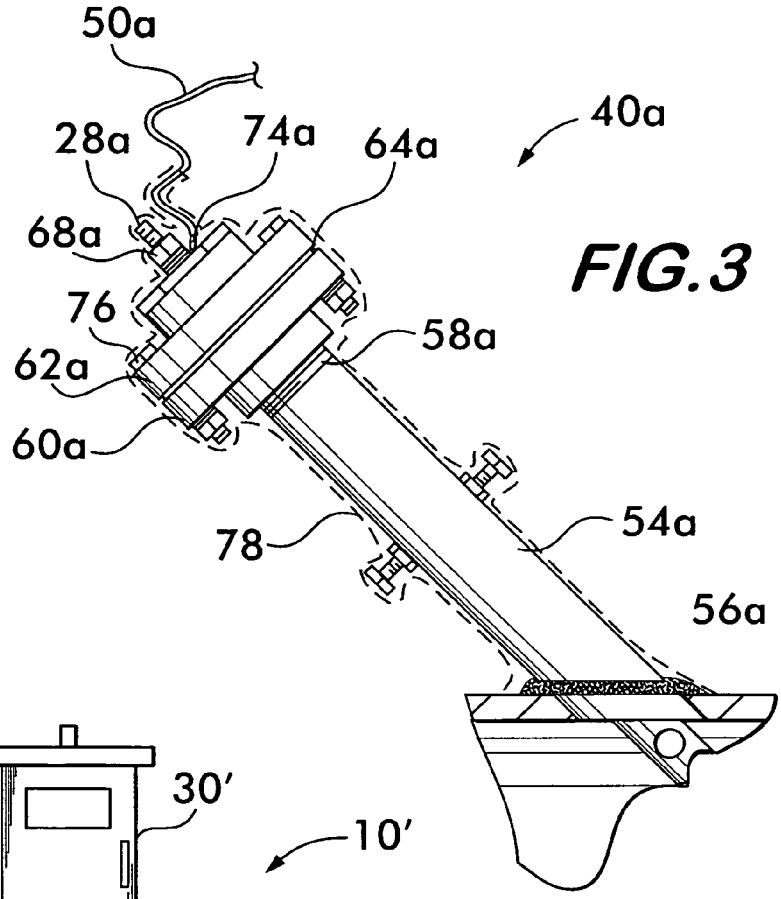
FIG. 3 is a side, elevational view of a pressure seal fitting of the internal cathodic protection system of FIG. 1.
Figure 4:
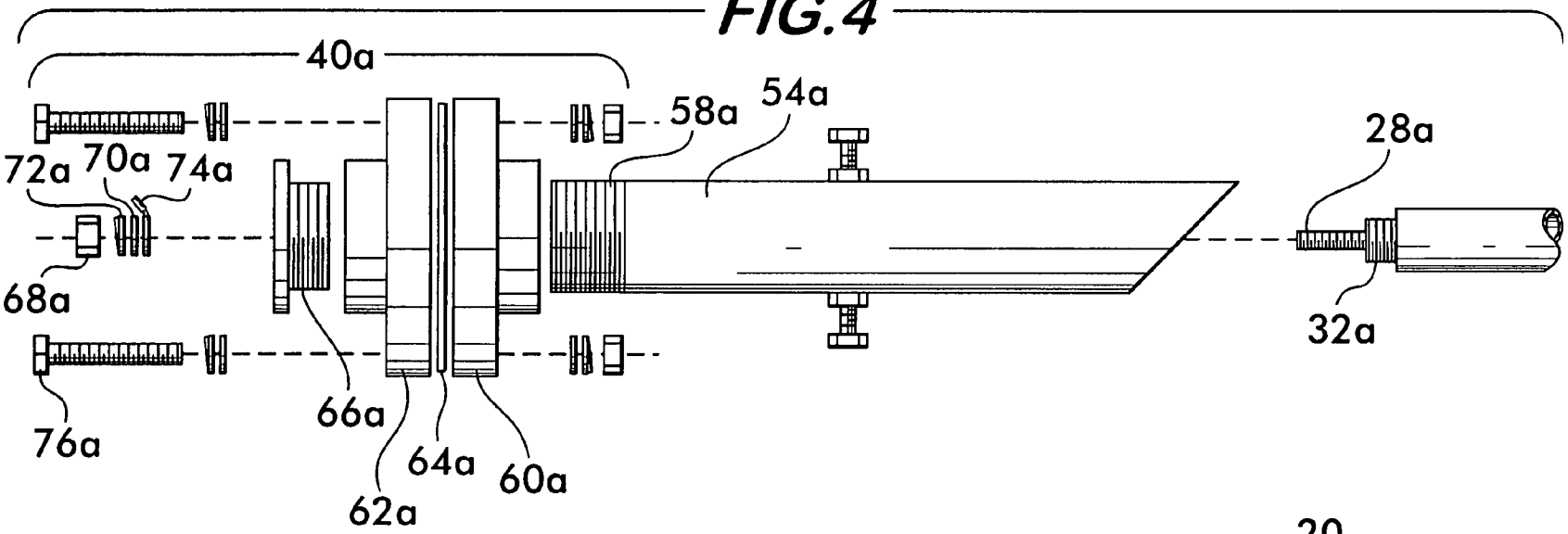
FIG. 4 is an exploded side view of an anode assembly of the internal cathodic protection system of FIG. 1.

Electrical contact between the rectifier 30 and the anode assembly is made through the first and second pressure seal fittings 40*a*, 40*b*. As can best be seen in FIG. 3, as well as the cutaway view of FIG. 2, a pipe nipple 54*a* is welded at an angle to the pipe 12 at weld 56*a* to form a seal. Pipe nipple 54*a* has a threaded end 58*a* at the end opposite the weld. As can best be seen in the exploded view of FIG. 4, a lower flange 60*a* is threaded onto the threaded end 58*a* of the pipe nipple 54*a*, a sealing gasket 64*a* is installed, and an internally threaded upper flange 62*a* is secured to the lower flange 60*a* capturing the gasket 64*a* therebetween. An exit reducer 66*a* is threaded into the upper flange having a clearance hole for the threaded rod 28*a* of the anode assembly 20.

As can best be seen in FIG. 2, the anode assembly 20 is inserted through a hole cut through the piping 12 at the location of the pipe nipple 54*a*. The threaded rod 28*a* is extended through the nipple 54*a*, through the gasket 64*a* and then held in place against the reducer 66*a* with hardware, for example, a nut 68*a*, washer 70*a* and lockwasher 72*a*. An electrical contact 74*a*, for example, a crimp-on type connector such as a ring tongue terminal connector or spade terminal connector, may also be secured on the threaded rod 28*a* to provide a connection point for a conductor wire 50*a*, 50*b* to be connected to the rectifier 30. The lower flange 60*a*, the upper flange 62*a*, and the reducer 66*a* may all be made from PVC. A device or devices to secure the housing 24 of the anode assembly 20 to the pipe nipple 54*a* may be used. For example, locking bolts 76*a* that clamp the housing 24 in place may be used.

Conductor wires 50*a*, 50*b* then attach to the connectors 74*a*, 74*b* and provide an electrical path to the rectifier 30. The rectifier may similar to that provided by, for example, Matcor, Inc. of Doylestown, Pa. Specifications would differ based on the physical requirements of the system.

Optionally, the entire outer surface of the nipple 54*a*, 54*b*, lower flange 60*a*, 60*b*, upper flange 62*a*, 62*b* and associated parts and hardware may be coated with a waterproof coating 78 as known in the art, for, for example, underground use.

One or more reference electrodes, as known in the art, for example, probe-type reference electrode 80 (see FIG. 1) may also be attached through the piping 12 and electrically connected to the rectifier to measure protection and to monitor the system 10.

By using the present system 10, pressure seal fittings 40*a*, 40*b* seal the internal volume 14 such that no liquid escapes from within the piping through the nipples 54*a*, 54*b*. However, electrical access to the anode 20 is provided. The embodiment herein includes one specific example, but, one skilled in the art will realize that there are numerous ways of achieving the same result. The system provides for easy installation, maintenance and removal of the anode assembly through one of the pressure seal fittings 40*a*, 40*b* by disassembling the flanges 60*a*, 60*b*, 62*a*, 62*b* as described above.

To assemble the system 10, the pipe nipples 54*a*, 54*b* are welded to the piping 12, the anode assembly 20 is threaded through one of the nipples 54*a* and extended through the piping 12 to the other of the nipples 54*b*. The anode assembly 20 is then secured and sealed in place using the parts as described above. Electrical connections are made and the system is operable.

Figure 6:
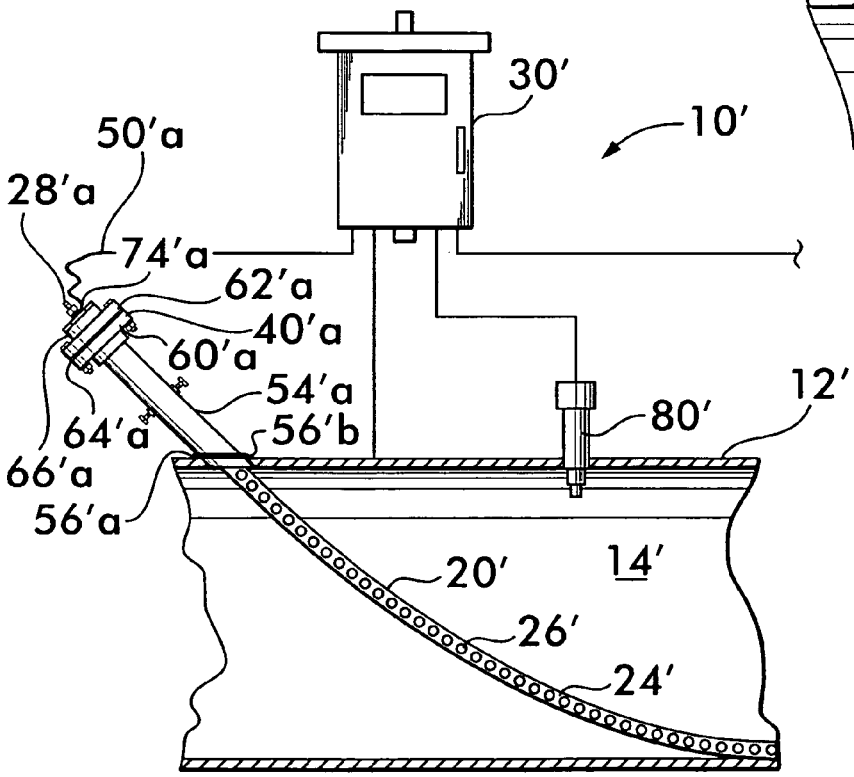
FIG. 6 is a simplified, partially cut-away, side elevational view of an internal cathodic protection system in accordance with a second preferred embodiment of the present invention.

A cathodic protection system 10' in accordance a second preferred embodiment of the present invention is shown in FIG. 6. For convenience, all like parts as compared to the cathodic protection system 10 in accordance with the first embodiment are designated with like part numbers, but having a prime symbol thereafter. For example, the rectifier 30 of the cathodic protection system 10 is comparable to rectifier 30' of the cathodic protection system 10' of the second embodiment. Here, the system 10' includes an anode assembly 20' that has only one end that is connected to the rectifier 30'. The second end of the anode assembly 20' including the anode wire and related parts is not physically connected within the piping 12'. One skilled in the art will realize that this system operates satisfactorily when properly designed.

Although illustrated and described herein with reference to specific embodiments, the present invention nevertheless is not intended to be limited to the details shown. Rather, various modifications may be made in the details within the scope and range of equivalents of the claims without departing from the spirit of the invention.

What is claimed is:

1. A cathodic protection system for internal surfaces of a pipeline, said pipeline having an internal volume, said cathodic protection system comprising:

(a) a flexible anode assembly having a first and a second end, said anode assembly comprising at least one flexible anode wire having a first end and a second end;

(b) a first removable pressure seal fitting for the first end of the anode assembly, said first pressure seal fitting providing for electrical contact between the first end of the anode assembly and a first contact outside of the internal volume of the pipeline;

(c) a second removable pressure seal fitting for the second end of the anode assembly, said second pressure seal fitting providing for electrical contact between the second end of the anode assembly and a second contact outside of the internal volume of the pipeline;

(d) a DC power source;

(e) a first anode conductor attached between the first contact and the DC power source; and (f) a second anode conductor attached between the second contact and the DC power source.

2. A cathodic protection system according to claim 1, further comprising a flexible, non-electrically conductive anode housing, said housing substantially surrounding the anode wire and extending generally from said first pressure seal fitting to said second pressure seal fitting.

3. A cathodic protection system according to claim 2, wherein the anode housing is fabricated from a perforated, semi-rigid plastic material.

4. A cathodic protection system according to claim 2, wherein the anode housing is constructed from plastic mesh tubing.

5. A cathodic protection system according to claim 1, wherein the anode wire is mixed metal oxide.

6. A cathodic protection system according to claim 5, wherein the anode wire has a copper core.

7. A cathodic protection system according to claim 1, wherein the anode wire is platinum coated titanium.

8. A cathodic protection system according to claim 7, wherein the anode wire has a copper core.

9. A cathodic protection system according to claim 1, wherein the anode wire is platinum coated niobium.

10. A cathodic protection system according to claim 9, wherein the anode wire has a copper core.

11. A cathodic protection system according to claim 1, wherein said first and said second pressure seal fittings are adapted to permit installation, removal, and repair of the anode assembly.

12. A cathodic protection system according to claim 1, wherein the DC power source includes a rectifier.

13. A cathodic protection system according to claim 1, including a waterproof coating over at least one the first pressure seal fitting and the second pressure seal fitting such that the anode assembly is adapted for underground use.

14. A cathodic protection system according to claim 1, including at least one reference electrode to measure cathodic protection levels and to monitor the anode assembly.

15. A cathodic protection system according to claim 1, including a separate anode cable to provide supplemental tensile strength to the anode wire.

16. A cathodic protection system for internal surfaces of a pipeline, said pipeline having an internal volume, said cathodic protection system comprising:

(a) an flexible anode assembly having a first and second end and comprising at least one flexible anode wire having a first end and a second end;

(b) a first removable pressure seal fitting for the first end of the anode assembly, said first pressure seal fitting providing for electrical contact between the first end of the anode assembly of the pipeline and a first contact outside of the internal volume of the pipeline;

(d) a DC power source;

(e) a first anode conductor attached between the first contact and the DC power source; and (f) said length of said anode assembly of a greater dimension than that of a diameter of the pipeline and free to move within the pipeline due to the flexibility of the anode assembly.

17. A cathodic protection system according to claim 16, further comprising a flexible, non-electrically conductive anode housing, said housing substantially surrounding the anode wire and extending generally from said first pressure seal fitting to said second end of said anode assembly.

18. A cathodic protection system according to claim 17, wherein the anode housing is fabricated from a perforated, semi-rigid plastic material.

19. A cathodic protection system according to claim 17, wherein the anode housing is constructed from plastic mesh tubing.

20. A cathodic protection system according to claim 16, wherein the anode wire is mixed metal oxide.

21. A cathodic protection system according to claim 20, wherein the anode wire has a copper core.

22. A cathodic protection system according to claim 16, wherein the anode wire is platinum coated titanium.

23. A cathodic protection system according to claim 22, wherein the anode wire has a copper core.

24. A cathodic protection system according to claim 16, wherein the anode wire is platinum coated niobium.

25. A cathodic protection system according to claim 24, wherein the anode wire has a copper core.

26. A cathodic protection system according to claim 16, wherein said first pressure seal fitting is adapted to permit installation, removal, and repair of the anode assembly.

27. A cathodic protection system according to claim 16, wherein the DC power source includes a rectifier.

28. A cathodic protection system according to claim 16, including a waterproof coating over the first pressure seal fitting such that the anode assembly is adapted for underground use.

29. A cathodic protection system according to claim 16, including at least one reference electrode to measure cathodic protection levels and to monitor the anode assembly.

30. A cathodic protection system according to claim 16, including a separate anode cable to provide supplemental tensile strength to the anode wire.

* * * * *